US008349165B2

(12) United States Patent
Tanaka et al.

(10) Patent No.: US 8,349,165 B2
(45) Date of Patent: Jan. 8, 2013

(54) PROCESS FOR PRODUCING AN ACTIVE CATHODE FOR ELECTROLYSIS

(75) Inventors: Yasuyuki Tanaka, Shunan (JP); Kenji Aoki, Shunan (JP)

(73) Assignee: Tokuyama Corporation, Shunan-Shi (JP)

( * ) Notice: Subject to any disclaimer, the term of this patent is extended or adjusted under 35 U.S.C. 154(b) by 146 days.

(21) Appl. No.: 13/123,772

(22) PCT Filed: Nov. 12, 2009

(86) PCT No.: PCT/JP2009/069590

§ 371 (c)(1), (2), (4) Date: Apr. 12, 2011

(87) PCT Pub. No.: WO2010/061766

PCT Pub. Date: Jun. 3, 2010

(65) Prior Publication Data

US 2011/0198230 A1 Aug. 18, 2011

(30) Foreign Application Priority Data

Nov. 25, 2008 (JP) ..... 2008-299345

(51) Int. Cl.
*C25B 1/16* (2006.01)
*C25B 11/04* (2006.01)

(52) U.S. Cl. ..... 205/508; 204/252; 204/290.01; 204/293; 205/220; 205/255; 205/510

(58) Field of Classification Search ..... 205/508; 204/293
See application file for complete search history.

(56) References Cited

U.S. PATENT DOCUMENTS

| | | | | | |
|---|---|---|---|---|---|
| 1,477,086 | A | * | 12/1923 | Suchy | 205/480 |
| 3,272,728 | A | * | 9/1966 | Hahndorff et al. | 205/223 |
| 4,024,044 | A | * | 5/1977 | Brannan et al. | 204/242 |
| 4,302,322 | A | * | 11/1981 | Oda et al. | 204/293 |
| 4,343,690 | A | | 8/1982 | de Nora | |
| 4,414,064 | A | * | 11/1983 | Stachurski et al. | 205/227 |
| 4,468,311 | A | | 8/1984 | de Nora et al. | |
| 4,617,101 | A | | 10/1986 | Sato et al. | |
| 4,801,368 | A | * | 1/1989 | Yamashita et al. | 204/293 |
| 5,954,928 | A | * | 9/1999 | Kishi et al. | 204/290.08 |
| 2003/0159923 | A1 | * | 8/2003 | Bergman et al. | 204/292 |

FOREIGN PATENT DOCUMENTS

JP 57-085981 A 5/1982

(Continued)

OTHER PUBLICATIONS

International Preliminary Report on Patentability and Translation of Written Opinion of the International Searching Authority, dated Jul. 14, 2011, for International Application No. PCT/JP2009/069590 (Forms PCT/IB/338, PCT/IB/373 and PCT/ISA/237).

(Continued)

*Primary Examiner* — Harry D Wilkins, III
*Assistant Examiner* — Bryan D. Ripa
(74) *Attorney, Agent, or Firm* — Birch, Stewart, Kolasch & Birch, LLP

(57) ABSTRACT

Soluble nickel and tin contained in a coating layer are eluted into an aqueous solution by bringing a cathode coated with a nickel-tin alloy into contact with an aqueous solution of an alkali metal hydrogen carbonate such as sodium hydrogen carbonate, thereby reducing the amounts of these metals eluted during electrolysis.

7 Claims, 1 Drawing Sheet

FOREIGN PATENT DOCUMENTS

| | | | |
|---|---|---|---|
| JP | 59-025986 | A | 2/1984 |
| JP | 60-29487 | A | 2/1985 |
| JP | 63-004920 | B2 | 2/1988 |
| JP | 63-053272 | B2 | 10/1988 |
| JP | 5-034434 | B2 | 5/1993 |
| JP | 2000-144470 | A | 5/2000 |
| JP | 2000-169990 | A | 6/2000 |
| JP | 3624394 | B2 | 6/2000 |
| JP | 2002-155391 | A | 5/2002 |
| JP | 3616265 | B2 | 11/2004 |
| JP | 3707985 | B2 | 8/2005 |
| JP | 3867913 | B2 | 10/2006 |

OTHER PUBLICATIONS

International Search Report for PCT/JP2009/069590, mailed on Dec. 15, 2009.

* cited by examiner

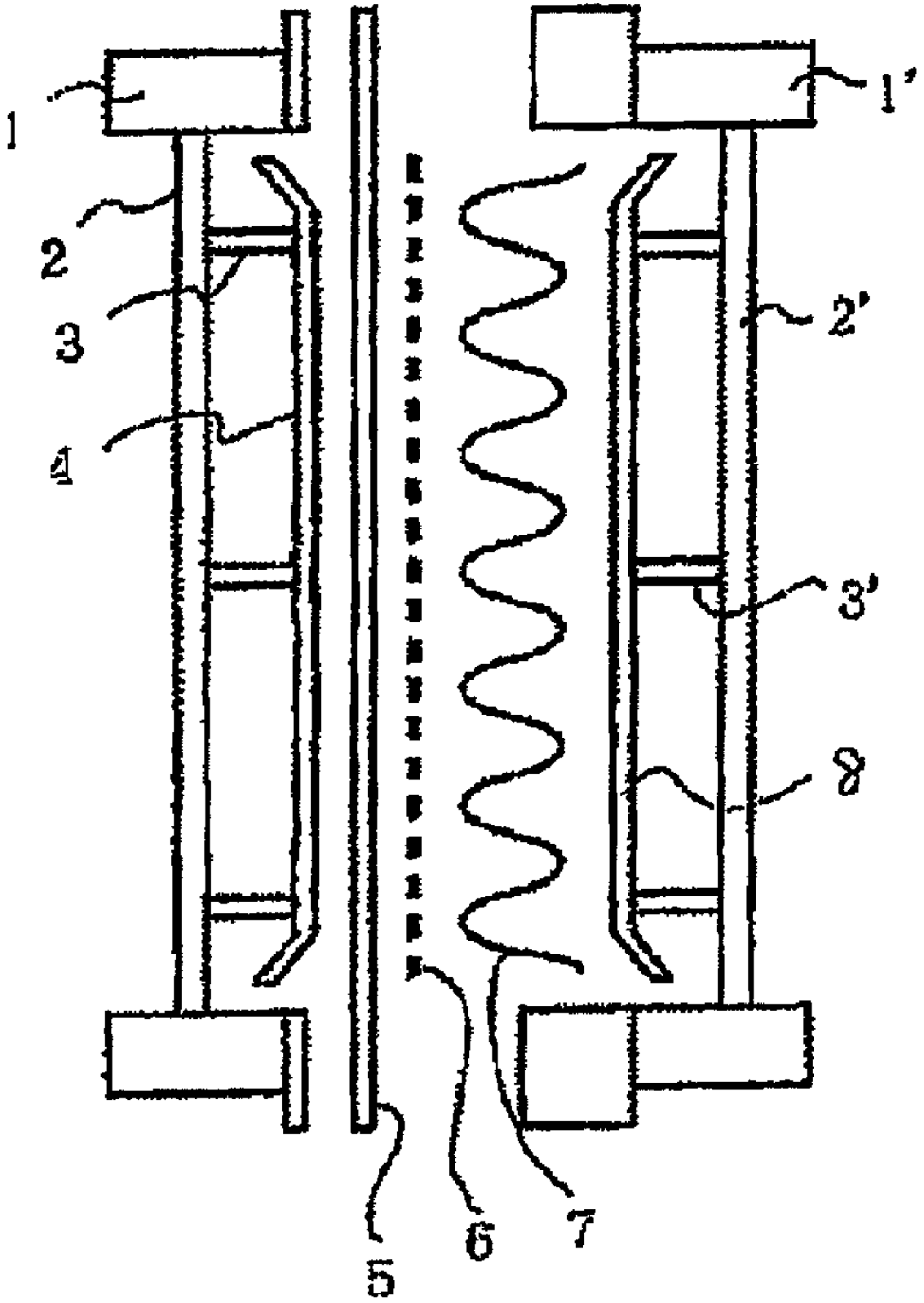
1
1'
2
2'
3
3'
4
5
6
7
8

PROCESS FOR PRODUCING AN ACTIVE CATHODE FOR ELECTROLYSIS

TECHNICAL FIELD

The present invention relates to a process for producing an electrolytic cathode used for the electrolysis of salt or the like. More specifically, it relates to a process for producing an active cathode for electrolysis in which a reduction in current efficiency and a rise in cell voltage hardly occur.

BACKGROUND ART

Heretofore, as a process for producing an alkali metal hydroxide through the electrolysis of an aqueous solution of an alkali metal salt, for example, a process for producing sodium hydroxide, chlorine and hydrogen through the electrolysis of an aqueous solution of sodium chloride, there have been known a process in which an anode chamber and a cathode chamber are demarcated by a cation exchange membrane, an anode is made existent in the anode chamber, a cathode is made existent in the cathode chamber, the anode chamber is filled with an aqueous solution of an alkali metal salt, the cathode chamber is filled with an aqueous solution of an alkali metal hydroxide, and DC current is applied between the both electrodes to carry out electrolysis as well as an ion exchange membrane electrolytic cell used in the process.

For the electrolysis of an aqueous solution of an alkali metal salt such as sodium chloride, a theoretical decomposition voltage is theoretically applied to obtain sodium hydroxide, chlorine and hydrogen equivalent to consumption power based on so-called "Faraday's law". However, in general, the voltage between electrodes rises to produce a power loss due to the overvoltages of the electrodes, the electric resistance of the cation exchange membrane and the electric resistance of an aqueous solution of sodium chloride and an aqueous solution of sodium hydroxide existent between the electrodes.

Then, in order to reduce the power loss, various attempts have been made to reduce the distance between the electrodes. JP-B 5-34434, JP-B 63-53272 and JP-B 57-85981 propose a so-called "zero-gap electrolytic cell" in which at least one of an anode and a cathode is pressed against the other electrode together with a cation exchange membrane by a spring material, an elastic mat material or a spring to be brought into close contact with it. The present invention can provide a cathode which is advantageously used in this zero-gap electrolytic cell, that is, an electrolytic cell in which the anode and the cathode are opposed to each other in such a manner that they sandwich the cation exchange membrane or they are opposed to each other through the cation exchange membrane with a small space there between.

Technical development has been made on the cation exchange membrane, and a membrane capable of electrolysis at a high current efficiency and a low voltage, that is, a membrane capable of operation at a low electric power consumption rate has been developed.

Meanwhile, as for the electrodes, a so-called "dimensionally stable anode (DSA)" which is obtained by coating the surface of a conductive material having resistance to an anode chamber liquid, such as a titanium material, with a platinum group metal, an oxide thereof or a mixture of one of these substances and an oxide of the group IV metal of the periodic table has been developed as the anode.

A conductive substrate such as a soft steel or nickel substrate has been commonly used in the cathode but there are proposed various so-called "active cathodes" which are obtained by coating the surface of the conductive substrate with a metal or an alloy to reduce hydrogen overvoltage. We have proposed an active cathode obtained by electroplating a conductive substrate made of soft steel or nickel with a nickel-tin alloy containing 25 to 99 wt % of nickel and 75 to 1 wt % of tin. The above active cathode has a hydrogen overvoltage 0.2 to 0.3 V lower than that of soft steel or nickel, thereby greatly reducing the electrolysis voltage (refer to JP-B 63-4920).

However, according to our subsequent studies, it was found that, when electrolysis was carried out continuously by using the active cathode electroplated with a nickel-tin alloy, the current efficiency dropped and the electrolysis voltage rose, that is, the deterioration of electrolytic performance was observed as days pass after energization. It was also found that the above active cathode had a bad influence upon the performance of an ion exchange membrane as nickel and tin on the surface of the active cathode liquated out and were introduced into the ion exchange membrane during the period from the injection of a liquid to energization after the ion exchange membrane was set in the electrolytic cell, thereby deteriorating electrolytic performance.

Meanwhile, after a surface coating layer is formed by a method such as plating, the active cathode for electrolysis is often washed with an alkali aqueous solution to remove an organic substance and an alkali-soluble component (refer to JP-A 59-25986, JP-A 2000-144470, Japanese Patent No. 3624394 and Japanese Patent No. 3867913).

These patent documents disclose only the use of an aqueous solution of an alkali hydroxide such as sodium hydroxide as the alkali aqueous solution.

However, according to studies conducted by the inventors of the present invention, it was found that, when the coating material for the active cathode is a nickel-tin alloy, if the active cathode is washed with an aqueous solution of an alkali hydroxide, soluble tin can be removed but not nickel and the deterioration of the performance of the ion exchange membrane cannot be avoided.

Therefore, even when the surface coating material for the conductive substrate is a nickel-tin alloy, a process in which soluble tin and nickel can be removed without fail and therefore excellent electrolysis can be carried out for a long time at a high efficiency or a low voltage without deteriorating the performance of an ion exchange membrane has been desired.

DISCLOSURE OF THE INVENTION

The inventors of the present invention have conducted studies on a treating agent for active cathodes for electrolysis whose surface is coated with a nickel-tin alloy and treating conditions, have succeeded in the development of the above process which has been desired to be developed and have arrived at the present invention.

It is therefore an object of the present invention to provide an electrolytic cathode which is obtained by surface treating an active cathode for electrolysis coated with a nickel-tin alloy before electrolysis to remove soluble tin and nickel on the surface of the active cathode so as to prevent the introduction of the soluble tin and nickel into an ion exchange membrane and capable of continuing electrolysis for a long time at a high efficiency and a low voltage without deteriorating the performance of the ion exchange membrane thereby as well as a production process therefor.

It is another object of the present invention to provide an electrolytic cell having the above electrolytic cathode of the present invention.

Other objects and advantages of the present invention will become apparent from the following description.

According to the present invention, firstly, the above objects and advantages of the present invention are attained by a process for producing an electrolytic cathode, comprising bringing an electrode obtained by coating the surface of a conductive substrate with a nickel-tin alloy into contact with an aqueous solution of an alkali metal hydrogen carbonate.

Secondly, the above objects and advantages of the present invention are attained by an electrolytic cathode produced by the above production process of the present invention.

Thirdly, the above objects and advantages of the present invention are attained by an electrolytic cell having the above electrolytic cathode of the present invention.

BRIEF DESCRIPTION OF THE DRAWINGS

FIG. 1 is a schematic diagram of a zero-gap electrolytic cell.

| Explanation of reference numerals | |
|---|---|
| 1, 1': | electrolytic cell frame |
| 2, 2': | rear partition |
| 3, 3': | rib |
| 4: | anode |
| 5: | ion exchange membrane |
| 6: | cathode |
| 7: | elastic mat |
| 8: | cathode collector plate |

BEST MODE FOR CARRYING OUT THE INVENTION

The production process of the present invention is a process for producing an electrolytic cathode by coating the surface of a conductive substrate with a nickel-tin alloy.

The conductive substrate is made of a conductive material and generally resistant to an environment where it is used as a cathode. It is preferably made of nickel, iron, titanium or stainless alloy steel. The base material of the conductive substrate is not limited to a metal, and a substance which is generally called "resin" and coated with a conductive metal component having corrosion resistance in a system used may be used.

From the viewpoint of durability, nickel or a nickel alloy is particularly preferred.

The shape of the substrate preferably conforms to a desired electrode shape as the shape of an electrode is generally derived from the shape of a conductive substrate. The shape of the electrode is, for example, a flat plate-like, curved plate-like, expand metal-like, punched metal-like, net-like, porous plate-like or barred lattice-like shape.

In the present invention, the surface of a substrate having corrosion resistance and conductivity is coated with a nickel-tin alloy. A coating method known per se is used for coating. For example, electroplating, hot dipping, nonelectrolyte plating, dry coating (such as deposition or sputtering) or flame spray coating may be employed. Out of these, electroplating is preferred. A conventional known nickel-tin alloy electroplating method is employed even when the nickel-tin alloy is coated by electroplating. The electroplating is preferably carried out by the following procedure. The nickel-tin alloy is an alloy comprising nickel and tin as the main ingredients and may further contain a metal component other than nickel and tin in a small amount, preferably not more than 10 wt % as required.

Prior to plating with the nickel-tin alloy, the surface of the conductive substrate is desirably subjected to a general pretreatment for electroplating, such as degreasing or etching. A method known per se is used. Electroplating may be referred to as "plating" hereinafter unless stated otherwise.

As metal sources for nickel and tin which are contained in a plating solution, metal salts such as chloride salts, sulfates, nitrates, bromide salts, iodide salts, sulfamine acid salts and citrates which are generally used for plating are used alone or in combination and dissolved in water, ethanol or butanol, etc. to prepare a plating bath.

Known additives may be added to the plating solution. Examples of a third component to be added as an additive include amino acids such as glycine, α-alanine, (β-alanine, histidine, praline, valine, aspartic acid and glutamic acid; amines such as pyridine, pyrazole and ethylenediamine; oxycarboxylic acids such as citric acid and tartaric acid, and salts thereof; sulfur-containing compounds such as thiourea and xanthogenic acid; cresol sulfonic acid and salts thereof; and aminosulfonic acid and salts thereof such as sulfamic acid and salts thereof.

As for pH of the plating solution which differs according to a metal salt in use and the type of an additive in use, the optimum pH is preferably selected. The control of pH is carried out by adding an acid such as hydrochloric acid, phosphoric acid or hydrofluoric acid, or an alkali such as sodium carbonate, sodium hydroxide or ammonia water according to a metal salt and an additive in use. As a matter of course, these acids and alkalis may be preferably used as a buffer agent.

The above substrate is immersed in the above plating solution and a current is applied to the plating solution to coat the surface of the substrate with a nickel-tin alloy. The temperature of the plating solution at this point is preferably 20 to 80° C.

The current density for plating is preferably 0.1 to 30 $A/dm^2$. Since the suitable current density range differs according to the composition of the plating solution, the optimum current density is selected in consideration of productivity and plating peel property.

In the present invention, after the surface of the substrate is coated with a nickel-tin alloy as described above, it is brought into contact with an aqueous solution of an alkali metal hydrogen carbonate. By bringing the substrate into contact with the aqueous solution of an alkali metal hydrogen carbonate, nickel and tin rarely liquate out from the electrodes after the treatment, thereby making it possible to maintain a high current efficiency and a low electrolysis voltage for a long time.

Examples of the alkali metal hydrogen carbonate include lithium hydrogen carbonate, sodium hydrogen carbonate, potassium hydrogen carbonate, rubidium hydrogen carbonate and cesium hydrogen carbonate. Out of these, sodium hydrogen carbonate and potassium hydrogen carbonate are preferred from the viewpoints of cost, solubility in water and the elution efficiency of nickel and tin.

The concentration of the aqueous solution of an alkali metal hydrogen carbonate which differs according to the type of the alkali metal hydrogen carbonate in use and the temperature of the aqueous solution is preferably 0.05 to 5.0 mol/L, more preferably 0.5 to 3.0 mol/L, particularly preferably 1.0 to 2.0 mol/L. As the concentration becomes higher, the elution property of nickel and tin becomes higher. However, when the concentration is made above the above range, its effect reaches a ceiling and the preparation of a high-concentration solution becomes difficult due to its solubility disadvantageously.

In the present invention, to prepare the aqueous solution of an alkali metal hydrogen carbonate, for example, an alkali metal hydrogen carbonate should be dissolved in water.

Another substance, for example, a pH control agent may be contained in the aqueous solution of an alkali metal hydrogen carbonate as long as the effect of the present invention is not impaired.

In the present invention, the above aqueous solution of an alkali metal hydrogen carbonate is brought into contact with an electrode obtained by coating the surface of a conductive substrate with the above nickel-tin alloy (to be referred to as "coated electrode" hereinafter). This contact is carried out by a method in which the coated electrode is immersed in the aqueous solution of an alkali metal hydrogen carbonate or a method in which the aqueous solution of an alkali metal hydrogen carbonate is sprayed onto the coated electrode. The method in which the coated electrode is immersed in the aqueous solution of an alkali metal hydrogen carbonate (to be referred to as "immersion method" hereinafter) is preferred because a contact treatment is easy and the electrode can be contacted uniformly.

The temperature for bringing the coated electrode into contact with the aqueous solution of an alkali metal hydrogen carbonate is preferably not lower than 5° C. and not higher than 80° C., more preferably not lower than 20° C. and not higher than 70° C., particularly preferably not lower than 30° C. and not higher than 60° C. as long as the aqueous solution of an alkali metal hydrogen carbonate can be kept liquid. As the temperature becomes higher, the elution efficiency becomes higher. However, since the aqueous solution of an alkali metal hydrogen carbonate having a high temperature decomposes quickly, the temperature is particularly preferably about 40° C.

When the contact is carried out by the immersion method, the immersion time which differs according to the temperature and the concentration of the aqueous solution of an alkali metal hydrogen carbonate is preferably 0.5 to 24 hours, more preferably 1 to 12 hours.

To elute soluble nickel and tin completely, the contact time should be prolonged to a certain extent. However, when the contact time is too long, industrial practicality degrades.

When the contact is carried out by the immersion method, the amount of the aqueous solution of an alkali metal hydrogen carbonate is such that the contact surface of the coated electrode is totally immersed in the solution, for example, 50 to 200 L based on 1 $m^2$ of the contact surface.

When the contact is carried out by the immersion method, it is also preferred to stir the aqueous solution of an alkali metal hydrogen carbonate or to apply ultrasonic radiation.

After the contact of the aqueous solution of an alkali metal hydrogen carbonate with the coated electrode, the surface of the coated electrode is preferably cleaned by rinsing or the like to remove the alkali metal hydrogen carbonate from the surface before the coated electrode is used as an electrolytic cathode.

The electrolytic cathode manufactured as described above may be used in an electrolytic cell for generating hydrogen from an electrolyte such as an alkali metal salt exemplified by sodium chloride and potassium chloride, particularly a chloride in accordance with a commonly known method. It is particularly preferably used as an electrolytic cathode when sodium chloride is electrolyzed by the ion exchange membrane method.

The electrolytic cathode of the present invention is set in the so-called "zero-gap electrolytic cell" as disclosed by Japanese Patent No. 3616265. Describing the structure of the zero-gap electrolytic cell, one electrode is a rigid porous plate, the other electrode is a specific soft porous plate electrode with a cation exchange membrane sandwiched between them, and the soft porous plate electrode is pressed against the rigid porous plate electrode together with the ion exchange membrane by an elastic mat collector which is composed of a specific metal assembly.

FIG. 1 shows an example of the electrolytic cell. FIG. 1 is a development view of one bipolar electrolytic cell. A monopole electrolytic cell has the same structure.

In the figure, 1 and 1' denote a unit cell frame (electrolytic cell frame) which is made of a metal such as soft steel or may be made of a reinforced plastic having durability against an electrolyte. Each unit cell is demarcated from an adjacent cell by a rear partition 2 or 2'. The rear partition is generally made of a metal , normally a titanium material and lined together with a cell frame portion because a chlorine gas is generated during the electrolysis of an aqueous solution of sodium chloride. In the bipolar electrolytic cell, electricity is supplied from the adjacent cell and introduced from an anode chamber rib 3 to an anode 4 through the rear partition. In FIG. 1, the anode is shown as a rigid porous plate for the sake of explanation but may be a cathode as a matter of course. The anode porous plate is a so-called "stable anode" having an ordinary shape which is an expand metal or net-like product obtained by coating a titanium substrate with a platinum metal oxide, or a mixture or mixed crystal of the platinum metal oxide and another metal oxide as an anode active substance and well known among people having ordinary skill in the art. Reference numeral 5 denotes a cation exchange membrane called "Nafion (trade name)" which has a perfluorocarbon skeleton and a cation exchange group such as sulfonic acid group, carboxylic acid group, phosphoric acid group or mixture thereof in the side chain. A space demarcated by the cation exchange membrane 5, the unit cell frame 1 and the rear partition 2 and containing the anode 4 therein is an anode chamber. There are a cathode 6 and an elastic mat 7 on the opposite side of the anode chamber with the cation exchange membrane interposed therebetween, and a cathode collector plate 8 which is a rigid porous plate may be existent as required. The space up to the rear partition may be filled with the elastic mat without using this cathode collector plate. This is particularly effective when the thickness of the cathode chamber is small, that is, the distance between the ion exchange membrane and the rear partition is small, for example, 20 mm or less. However, to ensure a sufficiently wide flow passage for a liquid or air bubbles, or to distribute a current uniformly over the entire surface of the cathode, the collector plate is preferably used.

A space demarcated by the unit cell frame 1', the rear partition 2' and the cation exchange membrane 5 and containing the cathode 6 and the elastic mat 7 therein is a cathode chamber.

The above elastic mat 7 is composed of a fabric which comprises a metal wire having a line diameter of 0.02 to 0.15 mm described in Japanese Patent No. 3707985 and is crimped and provided with mountain-shaped herringbone patterns. A fabric having herringbone patterns curved 2 to 9 times at an angle of 120 to 160° is preferably used.

When a cathode conductive plate is used, the cathode 6, the elastic mat 7 and the cathode collector plate 8 are preferably fixed as an assembly by a pin described in Japanese Patent No. 3686270.

The following examples are provided to further illustrate the present invention.

EXAMPLES

Example 1

0.125 mol/L of nickel chloride hexahydrate, 0.063 mol/L of stannous chloride dihydrate, 0.5 mol/L of potassium pyrophosphate and 0.5 mol/L of glycine were dissolved in water to prepare a plating bath whose pH and temperature were adjusted to 8.2 and 50° C. by using ammonia water, respectively.

A nickel metal net which had been degreased by a solvent and etched with iron chloride was used as a conductive substrate and electroplated at a current density of 5 A/dm$^2$ to form an electrodeposited product of a nickel-tin alloy on the substrate so as to manufacture an electrode (active cathode) coated with the nickel-tin alloy.

Then, this active cathode was immersed in a solution of sodium hydrogen carbonate having a concentration of 0.6 mol/L and a temperature of 40° C. by circulating the solution for 6 hours. The evaluation of the treatment effect was carried out by measuring the amounts of nickel and tin eluted from the surface of the active cathode as the concentrations of nickel and tin in the solution of sodium hydrogen carbonate after immersion by IPC. The results are shown in Table 1.

Examples 2 to 6 and Comparative Examples 1 to 3

After a cathode was manufactured in the same manner as in Example 1, the alkali solution and the immersion temperature were changed as shown in Table 1 to treat the coated electrode. The results are shown in Table 1.

TABLE 1

| | Treatment | | Alkali | Concentrations of eluted Ni and Sn (ppm) | |
|---|---|---|---|---|---|
| | temperature (° C.) | Type of used alkali | concentration (mol/1) | Concentration of Ni | Concentration of Sn |
| Example 1 | 40 | $NaHCO_3$ | 0.6 | 24 | 9 |
| Example 2 | 40 | $NaHCO_3$ | 1.2 | 67 | 18 |
| Example 3 | 60 | $NaHCO_3$ | 0.6 | 30 | 9 |
| Example 4 | 60 | $NaHCO_3$ | 1.2 | 79 | 17 |
| Example 5 | 40 | $KHCO_3$ | 1.2 | 80 | 19 |
| Example 6 | 40 | $KHCO_3$ | 2.4 | 117 | 31 |
| Comparative Example 1 | 40 | — | — | 5 | ND |
| Comparative Example 2 | 40 | NaOH | 1.2 | ND | 49 |
| Comparative Example 3 | 40 | $Na_2CO_3$ | 1.2 | ND | 5 |

ND means "below the detection limit".

Examples 7 and 8 and Comparative Examples 4 and 5

The active cathode was cut to a predetermined size and a saline electrolysis test was carried out with a small-sized electrolysis experimental apparatus having an energization area of 0.5 dm$^2$. The electrolysis conditions include a NaOH concentration of 32% and an NaCl concentration of 200 g/L at the outlet, a temperature of 90° C. and a current density of 50 A/dm$^2$. There were no gap between the cathode and the ion exchange membrane and no gap between the anode and the ion exchange membrane. The results are shown in Table 2.

Changes in current efficiency and voltage after energization are changes in current efficiency and voltage at the time of the number of days elapsed after energization based on the time when the current efficiency and the voltage become stable after the start of energization.

TABLE 2

| | Active cathode treatment conditions | Number of days elapsed after energization (days) | Change in current efficiency (%) | Change in voltage (mV) |
|---|---|---|---|---|
| Example 7 | Example 1 | 90 | −0.1 | +2 |
| | | 180 | −0.2 | +5 |
| Example 8 | Example 5 | 90 | −0.1 | +2 |
| | | 180 | −0.2 | +6 |
| Comparative Example 4 | Comparative Example 1 | 90 | −0.3 | +6 |
| | | 180 | −0.6 | +25 |
| Comparative Example 5 | Comparative Example 2 | 90 | −0.3 | +6 |
| | | 180 | −0.5 | +20 |

The invention claimed is:

1. A process for producing an electrolytic cathode, comprising bringing an electrode obtained by coating the surface of a conductive substrate with a nickel-tin alloy into contact with an aqueous solution of an alkali metal hydrogen carbonate.

2. The production process according to claim 1, wherein the concentration of the alkali metal hydrogen carbonate in the aqueous solution of the alkali metal hydrogen carbonate is 0.05 to 5.0 mol/L.

3. The production process according to claim 1, wherein the electrode coated with the nickel-tin alloy is manufactured by electroplating the surface of the conductive substrate with the nickel-tin alloy.

4. The production process according to any one of claims 1 to 3, wherein the electrolytic cathode is a cathode for the electrolysis of an alkali metal salt.

5. A method of electrolyzing an alkali metal salt, using an electrolytic cathode manufactured by the production process of claim 4.

6. An electrolytic cathode manufactured by the production process of claim 1.

7. An electrolytic cell having the electrolytic cathode of claim 6.

* * * * *